US005604089A

United States Patent [19]

Ikegawa et al.

[11] Patent Number: 5,604,089

[45] **Date of Patent: *Feb. 18, 1997**

[54] SILVER HALIDE PHOTOGRAPHIC MATERIAL

[75] Inventors: Akihiko Ikegawa; Yuji Mihara, both of Kanagawa, Japan

[73] Assignee: Fuji Photo Film Co., Ltd., Kanagawa, Japan

[ * ] Notice: The term of this patent shall not extend beyond the expiration date of Pat. No. 5,290,676.

[21] Appl. No.: 557,901

[22] Filed: Nov. 14, 1995

Related U.S. Application Data

[63] Continuation of Ser. No. 306,444, Sep. 19, 1994, which is a continuation of Ser. No. 91,566, Jul. 15, 1993.

[30] Foreign Application Priority Data

Jul. 21, 1992 [JP] Japan ..... 4-193839

[51] Int. Cl.[6] ..... G03C 1/14; G03C 1/16; G03C 1/18; G03C 1/20

[52] U.S. Cl. ..... 430/584; 430/583; 430/588; 430/598

[58] Field of Search ..... 430/584, 588, 430/598, 583

[56] References Cited

U.S. PATENT DOCUMENTS

| | | | |
|---|---|---|---|
| 3,264,110 | 8/1966 | Depoorter et al. | 430/584 |
| 3,282,933 | 11/1966 | Nys et al. | 430/588 |
| 3,615,634 | 10/1971 | Gotze et al. | 430/588 |
| 4,118,228 | 10/1978 | Corluy et al. | 430/588 |
| 4,524,128 | 6/1985 | Edwards et al. | 430/584 |
| 5,006,445 | 4/1991 | Yagihara et al. | 430/598 |
| 5,290,676 | 3/1994 | Nagaoka et al. | 430/583 |
| 5,308,748 | 5/1994 | Ikegawa et al. | 430/574 |
| 5,310,645 | 5/1994 | Ikegawa et al. | 430/574 |
| 5,364,755 | 11/1994 | Miyamoto et al. | 430/584 |
| 5,422,238 | 6/1995 | Ikegawa et al. | 430/584 |

FOREIGN PATENT DOCUMENTS

| | | | |
|---|---|---|---|
| 0451816 | 10/1991 | European Pat. Off. . | |
| 1223289 | 6/1960 | France | 430/588 |

*Primary Examiner*—Janet C. Baxter
*Attorney, Agent, or Firm*—Sughrue, Mion, Zinn, Macpeak & Seas

[57] ABSTRACT

There is disclosed a silver halide photographic material in which a residual color can be compatible with a sensitivity in a development processing. The photographic material comprises a support and provided thereon at least one silver halide emulsion layer containing at least one of the methine compounds represented by the following Formula (I) and at least one of the compounds represent-ed by the following Formula (II):

(I)

wherein $R^1$ represents $-(CH_2)_r-CONHSO_2-R^3$, $-(CH_2)_s-SO_2NHCO-R^4$, $-(CH_2)_t-CONHCO-R^5$, or $-(CR_2)_u-SO_2NHSO_2-R^6$, in which $R^3$, $R^4$, $R^5$ and $R^6$ each represent an alkyl group, an alkoxy group, or an amino group and r, s, t and u each repre-sent an integer of 1 to 5; $R^2$ is synonymous with $R^1$ or represents an alkyl group which is different from $R^1$; $Z^1$ and $Z^2$ may be the same or different and represent the group of non-metallic atoms necessary to form a 5- or 6-membered heterocyclic ring; $L_1$, $L_2$ and $L_3$ each represent a methine group; $n_1$ represents 0, 1 or 2; $X_1$ represents an anion; $k_1$ represents a number necessary to adjust a charge in a molecule to 0; and p and q each represent 0 or 1.

(II)

wherein $R_7$ represents an aliphatic group or an aromatic group; $R_8$ represents a hydrogen atom, an alkyl group, an aryl group, an alkoxy group, an aryloxy group, an amino group, or a hydrazino group; $G_1$ represents a —CO— group, a $-SO_2-$ group, a —SO— group, a $-P(O)R_9-$ group, a —CO—CO— group, a thiocarbonyl group, or an iminomethylene group; both of $A_1$ and $A_2$ represent a hydrogen atom, or either of them represents a hydrogen atom and another represents a substituted or unsubstituted alkylsulfonyl group, a substituted or unsubstituted arylsulfonyl group, or a substituted or unsubstituted acyl group; and $R_9$ is selected from the same groups as those defined for $R_8$ and may be different from $R_8$.

13 Claims, No Drawings

SILVER HALIDE PHOTOGRAPHIC MATERIAL

This is a continuation of application Ser. No. 08/306,444, filed Sep. 19, 1994, which is a continuation application of Ser. No. 08/091,566, filed Jul. 15, 1993.

FIELD OF THE INVENTION

The present invention relates to a silver halide photographic material which is improved in residual color in a development processing and sensitivity properties.

BACKGROUND OF THE INVENTION

Rapidity in development processing and the addition of a large amounts of sensitizing dyes in recent years have been accompanied with the significant problems that the sensitizing dyes contained in a silver halide photographic material are not completely eluted during processing and that coloring (so-called residual color) remains in the photographic material.

Sensitizing dyes have been investigated which offer decreased residual color, these dyes having a hydrophilic substituent such as a sulfamoyl group and a carbamoyl group (for example, JP-A-1-147451 (the term "JP-A" as used herein means an unexamined published Japanese patent application) and JP-A-61-294429, JP-B-45-32749 (the term "JP-B" as used herein means an examined Japanese patent publication), and JP-A-61-77843). However, the sensitivity is not sufficient in any of those dyes since an increase in the hydrophilicity of a sensitizing dye generally lowers its absorption. Residual color also does not reach a sufficiently satisfactory level. While a residual color improvement effect can be observed in the sensitizing dyes described in U.S. Pat. No. 3,282,933 and European Patent 451816A1, a sufficient effect is not obtained in terms of compatibility of residual color with sensitivity.

SUMMARY OF THE INVENTION

Accordingly, an object of the present invention is to provide a silver halide photographic material in which the residual color effect is compatible with sensitivity in development processing.

These and other objects of the present invention have been achieved by a silver halide photographic material comprising a support having provided thereon at least one silver halide emulsion layer containing at least one methine compound represented by the following Formula (I) and at least one compound represented by the following Formula (II):

Formula (I)

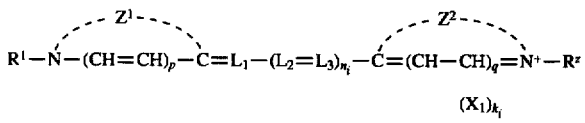

wherein $R^1$ represents $—(CH_2)_r—CONHSO_2—R^3$, $—(CH_2)_s—SO_2NHCO—R^4$, $—(CH_2)_t—CONHCO—R^5$, or $—(CH_2)_u—SO_2NHSO_2—R^6$, in which $R^3$, $R^4$, $R^5$ and $R^6$ each represents an alkyl group, an alkoxy group, or an amino group, and r, s, t and u each represents an integer of 1 to 5; $R^2$ is defined in the same manner as $R^1$ or represents an alkyl group which is different from $R^1$; $R^1$ and $R^2$ may be the same or different; $Z^1$ and $Z^2$ may be the same or different and each represents a group of non-metallic atoms necessary to form a 5- or 6-membered heterocyclic ring; $L_1$, $L_2$ and $L_3$ each represents a methine group; $n_1$ represents 0, 1 or 2; $X_1$ represents an anion; $k_1$ represents a number necessary to adjust charge in the compound to 0; and p and q each represents 0 or 1;

Formula (II)

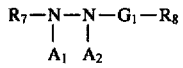

wherein $R_7$ represents an aliphatic group or an aromatic group; $R_8$ represents a hydrogen atom, an alkyl group, an aryl group, an alkoxy group, an aryloxy group, an amino group, or a hydrazino group; $G_1$ represents —CO—, $—SO_2—$, —SO—, $—P(O)R_9—$, —CO—CO—, a thiocarbonyl group, or an iminomethylene group; both $A_1$ and $A_2$ represent a hydrogen atom, or either of them represents a hydrogen atom and the other represents a substituted or unsubstituted alkylsulfonyl group, a substituted or unsubstituted arylsulfonyl group, or a substituted or unsubstituted acyl group; and $R_9$ is defined in the same manner as $R_8$ and may be the same as or different from $R_8$.

The compounds represented by Formula (I) and Formula (II) are described below in detail.

The alkyl group represented by $R^3$, $R^4$, $R^5$ or $R^6$ may be substituted and is preferably a group having a carbon number of 1 to 4. Particularly preferred are methyl, ethyl, methoxyethyl, hydroxyethyl, and amino-ethyl groups. The alkoxy group may be substituted and is preferably a group having a carbon number of 1 to 4. Particularly preferred are methoxy, ethoxy, methoxyethoxy, and hydroxyethoxy groups. The amino group may be substituted with an alkyl group, a hydroxyalkyl group and an alkoxyalkyl group, and the substituents themselves may be combined to form a ring. A group having a carbon number of 0 to 8 is preferred. Particularly preferred are methylamino, dimethylamino, ethylamino, diethylamino, hydroxyethylamino, morpholino, and pyrrolidino groups. The hydrogen atom bonded to the nitrogen atom adjacent to a carbonyl group or a sulfonyl group in $R^1$ is dissociative. Therefore $R^1$ can have the form of $—(CH_2)_r—CON^-SO_2—R^3$, $—(CH_2)_s—SO_2N^-CO—R^4$, $—(CH_2)_t—CON^-CO—R^5$, or $—(CH_2)_u—SO_2N^-SO_2—R^6$ in the presence of base.

The alkyl group represented by $R^2$ is preferably a group having a carbon number of 1 to 5. Particularly preferred are methyl, ethyl, 2-sulfoethyl, 3-sulfopropyl, 4-sulfobutyl, and 3-sulfobutyl groups. Preferred as r, s, t or u is 1, 2 or 3.

5- or 6-membered heterocyclic nucleus formed by $Z_1$ and $Z_2$ may be a thiazole nucleus [a thiazole nucleus (for example, thiazole, 4-methylthiazole, 4-phenylthiazole, 4,5-dimethylthiazole, and 4,5-diphenylthiazole), a benzothiazole nucleus (for example, benzothiazole, 4-chloro-benzothiazole, 5-chlorobenzothiazole, 6-chlorobenzothiazole, 5-nitrobenzothiazole, 4-methylbenzothiazole, 5-methylbenzothiazole, 6-methylbenzothiazole, 5-bromobenzothiazole, 6-bromobenzothiazole, 5-iodobenzothiazole, 5-phenylbenzothiazole, 5-methoxybenzothiazole, 6-methoxybenzothiazole, 5-ethoxybenzothiazole, 5-ethoxycarbonylbenzothiazole, 5-carboxybenzothiazole, 5-phenethylbenzothiazole, 5-fluorobenzothiazole, 5-chloro-6-methylbenzothiazole, 5,6-dimethylbenzothiazole, 5,6-dimethoxybenzothiazole, 5-hydroxy-6-methylbenzothiazole, tetrahydroxybenzothiazole, and 4-phenylbenzothiazole), and a naphthothiazole nucleus (for example, naphtho [2,1-d] thiazole, naphtho [1,2-d] thiazole, naphtho [2,3-d] thiazole, 5-methoxynaphtho [1,2-d] thiazole, 7-ethoxy-naphtho [2,1-d] thiazole, 8-methoxy-naphtho [2,1-d] thiazole, and 5-methoxynaphtho [2,3-d]thiazole)]; a thiazoline nucleus (for example, thiazoline, 4-methylthiazoline and 4-nitrothiazoline); an oxazole nucleus [an oxazole nucleus (for example, oxazole, 4-methyloxazole, 4-nitroxazole, 5-methyloxazole, 4-phenyloxazole, 4,5-diphenyloxazole, and 4-ethyloxazole), a benzoxazole nucleus (for example, benzoxazole, 5-chlorobenzoxazole, 5-methylbenzoxazole, 5-bromobenzoxazole, 5-phenylbenzoxazole, 5-methoxybenzoxazole, 5-nitrobenzoxazole, 5-trifluoromethylbenzoxazole, 5-hydroxybenzoxazole, 5-carboxybenzoxazole, 6-methylbenzooxazole, 6-chlorobenzoxazole, 6-nitrobenzoxazole, 6-methoxybenzoxazole, 6-hydroxybenzoxazole, 5,6-dimethylbenzoxazole, 4,6-dimethylbenzoxazole, and 5-ethoxybenzooxazole), and a naphthoxazole nucleus (for example, naphtho [2,1-d] oxazole, naphtho [1,2-d] oxazole, naphtho [2,3-d] oxazole, and 5-nitronaphtho [2,1-d] oxazole)]; an oxazoline nucleus (for example, 4,4-dimethyloxazoline); a selenazole nucleus [a selenazole nucleus (for example, 4-methylseleneazole, 4-nitroselanazole, and 4-phenylselenazole), a benzoselenazole nucleus (for example, benzoselenazole, 5-cholorobenzoselenazole, 5-nitrobenzoselenazole, 5-methoxybenzo-selenazole, 5-hydroxybenzoselenazole, 6-nitrobenzoselenazole, 5-chloro-6-nitrobenzoselenazole, and 5,6-dimethylbenzo-selenazole), and a naphthoselenazole nucleus (for example, naphtho [2,1-d] selenazole and naphtho [1,2-d] selenazole)]; a selenazoline nucleus (for example, selenazoline and 4-methylselenazoline); a tellurazole nucleus [a tellurazole nucleus (for example, tellurazole, 4-methyltellurazole, and 4-phenyltellur-azole), a benzotellurazole nucleus (for example, benzo-tellurazole, 5-chlorobenzotellurazole, 5-methylbenzo-tellurazole, 5,6-dimethylbenzotellurazole, and 6-methoxybenzotellurazole), and a naphthotellurazole nucleus (for example, naphtho [2,1-d] tellurazole and naphtho [1,2-d] tellurazole)]; a tellurazoline nucleus (for example, tellurazoline and 4-methyltellurazoline); a 3,3-dialkylindolenine nucleus (for example, 3,3-dimethylindolenine, 3,3-diethylindolenine, 3,3-dimethyl-5-cyanoindolenine, 3,3-dimethyl-6-nitroindolenine, 3,3-dimethyl-5-nitroindolenine, 3,3-dimethyl-5-methoxyindolenine, 3,3,5-trimethylindolenine, and 3,3-dimethyl-5-chloroindolenine); an imidazole nucleus [an imidazole nucleus (for example, 1-alkylimidazole, 1-alkyl-4-phenylimidazole, and 1-arylimidazole), a benzimidazole nucleus (for example, 1-alkylbenzimidazole, 1-alkyl-5-chlorobenzimidazole, 1-alkyl-5,6-dichlorobenzimidazole, 1-alkyl-5-methoxybenzimidazole, 1-alkyl-5-cyanobenzimidazole, 1-alkyl-5-fluorobenzimidazole, 1-alkyl-5-trifluoromethylbenzimidazole, 1-alkyl-6-chloro-5-cyanobenzimidazole, 1-alkyl-6-chloro-5-trifluoromethyl-benzimidazole, 1-allyl-5,6-dichlorobenzimidazole, 1-allyl-5-chlorobenzimidazole, 1-arylbenzimidazole, 1-aryl-5-chlorobenzimidazole, 1-aryl-5,6-dichlorobenzimidazole, 1-aryl-5-methoxybenzimidazole, and 1-aryl-5-cyanobenzimidazole), and a naphthoimidazole nucleus (for example, alkylnaphtho [1,2-d] imidazole and 1-arylnaphtho [1,2d] imidazole), in which preferred as the above alkyl group is an alkyl group having a carbon number of 1 to 8, (for example, a unsubstituted alkyl group such as methyl, ethyl, propyl, isopropyl and butyl), and a hydroxalkyl group (for example, 2-hydroxyethyl and 3-hydroxypropyl), and particularly preferred are methyl and ethyl, and the above aryl group represents phenyl, phenyl substituted with a halogen atom (for example, chlorine), phenyl substituted with an alkyl group (for example, methyl), and phenyl substituted with an alkoxy group (for example, methoxy)]; a pyridine nucleus (for example, 2-pyridine, 4-pyridine, 5-methyl-2-pyridine, and 3-methyl-4-pyridine); a quinoline nucleus [a quinoline nucleus (for example, 2-quinoline, 3-methyl-2-quinoline, 5-ethyl-2-quinoline, 6-methyl-2-quinoline, 6-nitro-2-quinoline, 8-fluoro-2-quinoline, 6-methoxy-2-quinoline, 6-hydroxy-2-quinoline, 8-chloro-2-quinoline, 4-quinoline, 6-ethoxy-4-quinoline, 6-nitro-4-quinoline, 8-chloro-4-quinoline, 8-fluoro-4-quinoline, 8-methyl-4-quinoline, 8-methoxy-4-quinoline, 6-methyl-4-quinoline, 6-methoxy-4-quinoline, and 6-chloro-4-quinoline), and an isoquinoline nucleus (for example, 6-nitro-1-isoquinoline, 3,4-dihydro-1-isoquinoline, and 6-nitro-3-isoquinoline)]; an imidaso [4,5-b] quinoxaline nucleus (for example, 1,3-diethyl-imidaso [4,5-b] quinoxaline and 6-chloro-1,3-diallyl-imidaso [4,5-b] quinoxaline); an oxadiazole nucleus; a thiadiazole nucleus; a tetrazole nucleus; and a pyrimidine nucleus.

Among these heterocyclic nuclei, preferred are a thiazole nucleus, a benzothiazole nucleus, a naphtho-thiazole nucleus, an oxazole nucleus, a benzoxazole nucleus, a naphthoxazole nucleus, a benzimidazole nucleus, a naphthoimidazole nucleus, and a quinoline nucleus. Most preferred are a benzothiazole nucleus, a benzoselenazole nucleus, or a quinoline nucleus.

The methine groups represented by $L_1$, $L_2$ and $L_3$ may be substituted and the substitutents include an alkyl group which is optionally substituted (for example, methyl, ethyl, and 2-carboxyethyl), an aryl group which is optionally substituted (for example, phenyl and o-carboxyphenyl), a halogen atom (for example, a chlorine atom and a bromine atom), an alkoxy group (for example, methoxy and ethoxy), and an alylthio group (for example, methylthio and ethylthio). They may form a ring with the other methine groups or can form a ring with an auxochrome.

The anion represented by $X_1$ includes an inorganic or organic acid anion (for example, chloride, bromide, iodide, p-toluenesulfonate, naphthalenedisulfonate, methanesulfonate, methylsulfonate, ethylsulfonate, and perchlorate).

Preferred as $n_1$ is 0 or 1.

The methine compounds represented by Formula (I) can be synthesized according to the methods described in *Heterocyclic Compounds-Cyanine Dyes and Related Compounds* written by F. M. Harmer, published by John Wiley & Sons Co., Ltd. New York, London, (published in 1964); *Heterocyclic Compounds-Special Topics in Heterocyclic Chemistry* written by D. M. Sturmer, Chapter 18, Section 14, pp. 482 to 515, published by John Wiley & Sons Co., Ltd.(New York, London), published in 1977; and *Rodd's Chemistry of Carbon Compounds,* (2nd Ed. vol. IV, part B, published in 1977), Chapter 15, pp. 369 to 422, and (2nd Ed. vol. IV, part B, published in 1985), Chapter 15, pp. 267 to 296, edited by Elsevier Science Publishing Company Inc., New York.

Examples of the methine compounds represented by Formula (I) are shown below but the present invention is not limited thereto:

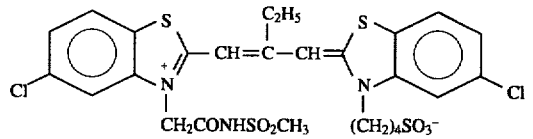
I-1
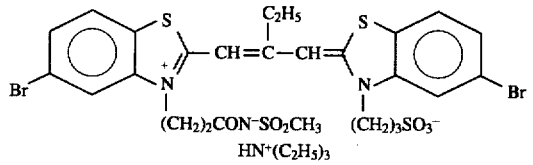
I-2
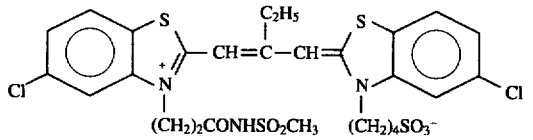
I-3
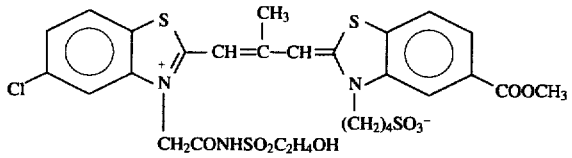
I-4
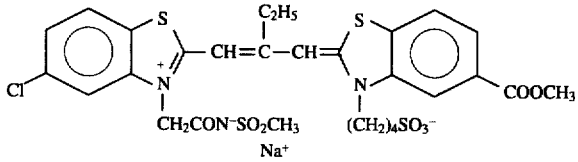
I-5
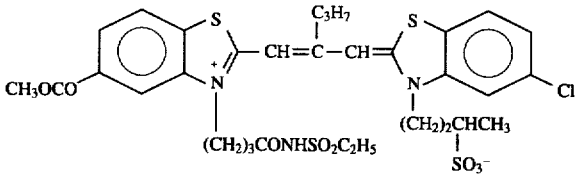
I-6
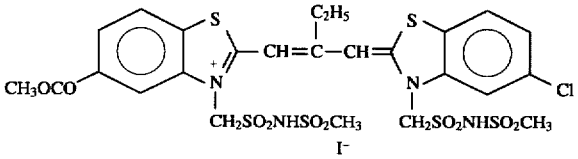
I-7
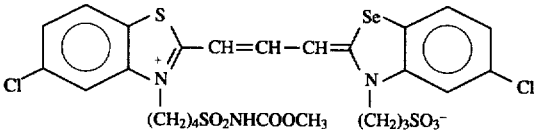
I-8
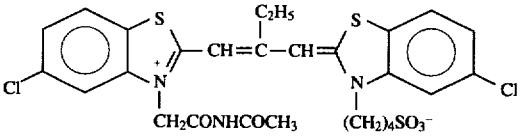
I-9
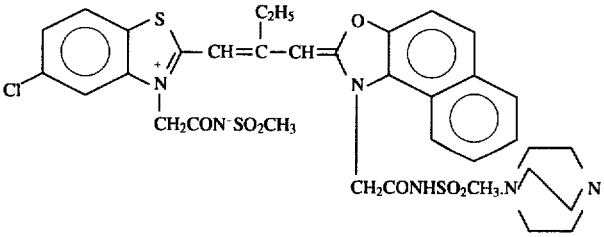
I-10

-continued
I-11
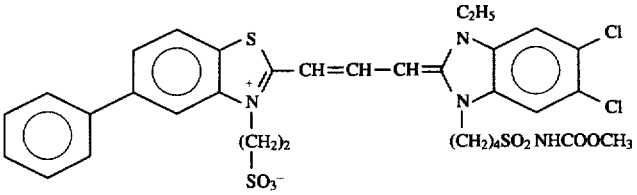
I-12
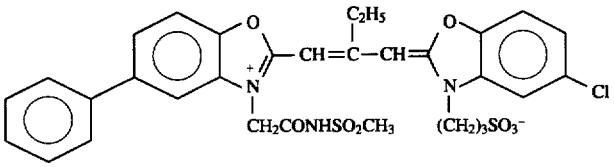
I-13
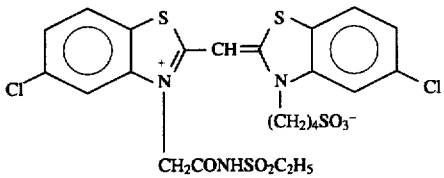
I-14
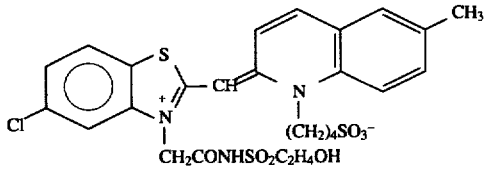
I-15
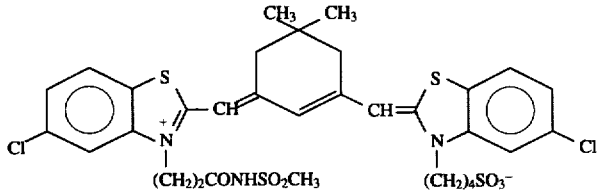
I-16
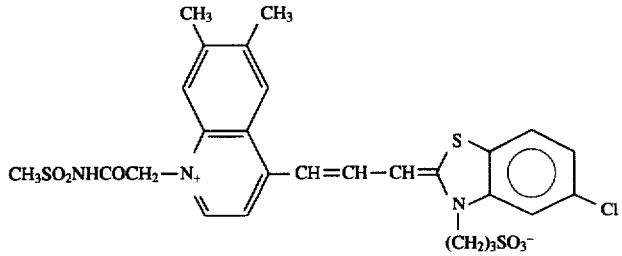
I-17
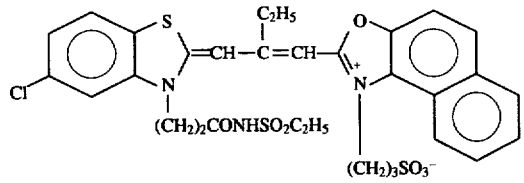
I-18
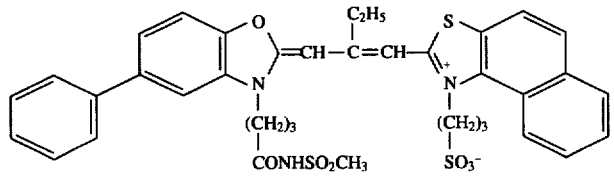

-continued
I-19
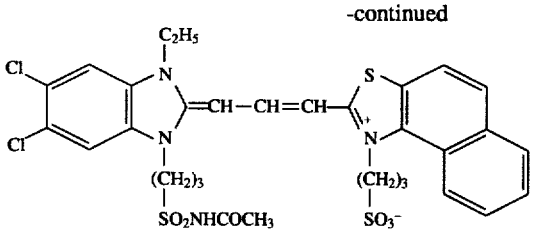
I-20
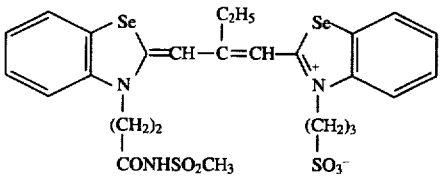
I-21
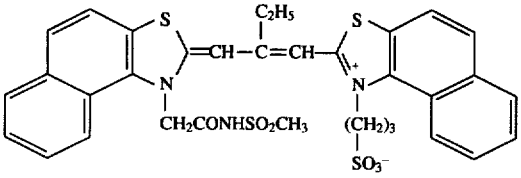
I-22
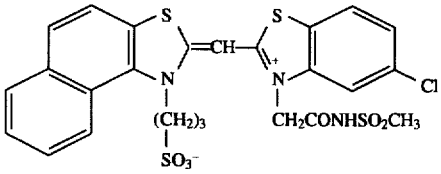
I-23
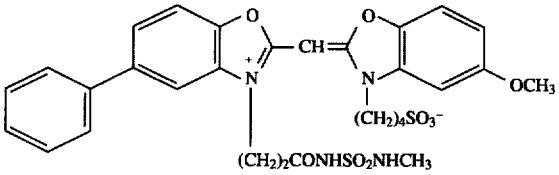
I-24
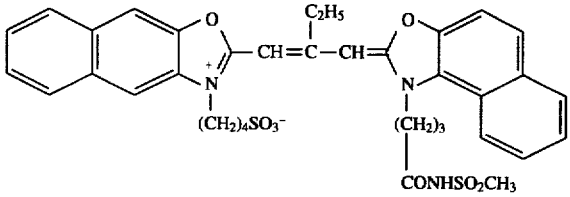
I-25
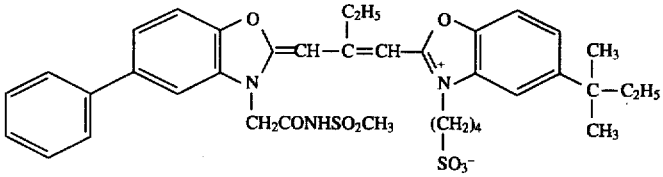
I-26
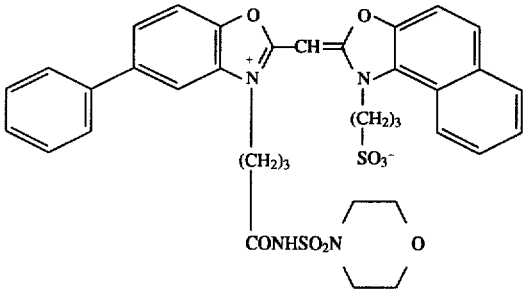

-continued

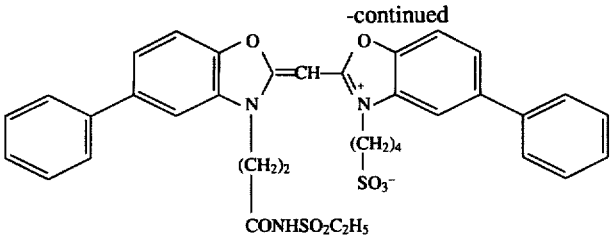

I-27

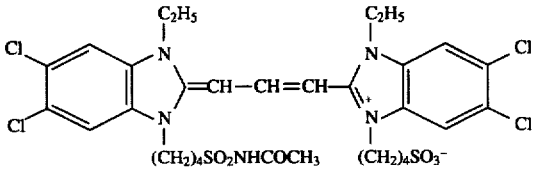

I-28

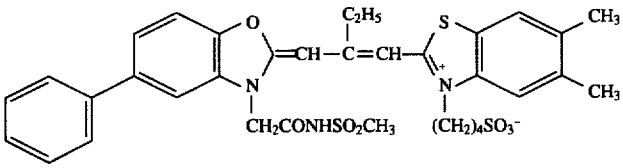

I-29

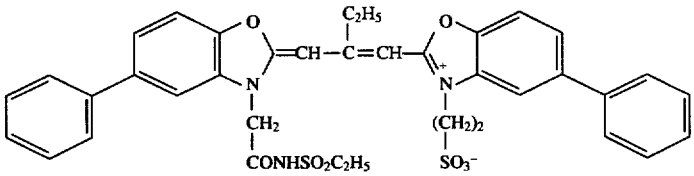

I-30

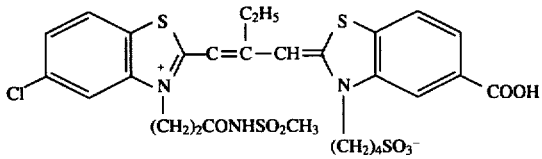

I-31

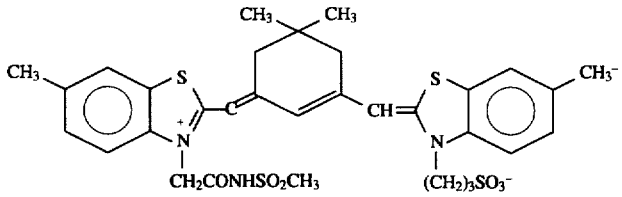

I-32

Among them, Compounds I-1, I-3 and I-29 are particularly preferred.

In Formula (II), the aliphatic group represented by $R_7$ preferably has a carbon number of 1 to 30 and particularly is a linear, branched or cyclic alkyl group having the carbon number of 1 to 20. This group may be substituted.

In Formula (II), the aromatic group represented by $R_7$ is a monocyclic or dicyclic aryl group or unsaturated heterocyclic group, wherein the unsaturated heterocyclic group may be condensed with an aryl group. Preferred as $R_7$ is an aryl group, particularly preferably an aryl group containing a benzene ring.

The aliphatic group or aromatic group represented by $R_7$ may be substituted, and there can be listed as representative substituents, for example, an alkyl group, an aralkyl group, an alkenyl group, an alkynyl group, an alkoxy group, an aryl group, a substituted amino group, a ureido group, a urethane group, an aryloxy group, a sulfamoyl group, a carbamoyl group, an alkyl- or arylthio group, an alkyl- or arylsulfonyl group, an alkyl- or arylsulfinyl group, a hydroxy group, a halogen atom, a cyano group, a sulfo group, an aryloxycarbonyl group, an acyl group, an alkoxycarbonyl group, an acyloxy group, a carbonamide group, a sulfon-amide group, a carboxyl group, a phosphoric acid amide group, a diacylamide group, an imide group, and $R_{10}$—NHCON($R_{11}$)—CO— (in which $R_{10}$ and $R_{11}$ are selected from the same groups as those defined for $R_8$ and may be different from each other). The preferred substituents are an alkyl group (having preferably a carbon number of 1 to 20), an aralkyl group (having preferably a carbon number of 7 to 30), an alkoxy group (having preferably a carbon number of 1 to 20), a substituted amino group (an amino group substituted with an alkyl group having preferably a carbon number of 1 to 20), an acylamino group (having preferably a carbon number of 2 to 30), a sulfonamide group (having preferably a carbon number of 1 to 30), a ureido group (having preferably a carbon number of 1 to 30), and a phosphoric acid amide group (having preferably a carbon number of 1 to 30). These groups may be further substituted.

The alkyl group represented by $R_8$ in Formula (II) is preferably an alkyl group having a carbon number of 1 to 4, and the aryl group represented by $R_8$ is preferably a monocyclic or dicyclic aryl group (for example, an aryl group containing a benzene ring).

Where $G_1$ is —CO—, the preferred groups represented by $R_8$ are a hydrogen atom, an alkyl group (for example, methyl, trifluoromethyl, 3-hydroxypropyl, 3-methanesulfonamidepropyl, and phenylsulfonylmethyl), an aralkyl group (for example, o-hydroxybenzyl), and an aryl group (for example, phenyl, 3,5-dichlorophenyl, o-methanesulfonamidephenyl, 4-methanesulfonylphenyl, and 2-hydoxymethylphenyl). A hydrogen atom is particularly preferred.

$R_8$ may be substituted and the substituents listed for $R_7$ can be applied.

The —CO— group is the most preferred as $G_1$ in Formula (II).

Also, $R_8$ may permit the portion of $G_1$—$R_8$ to split off from the remainder of the molecule and may cause a cyclization reaction by which a cyclic structure containing the atoms in the portion of —$G_1$—$R_8$ is formed. The compounds described in, for example, JP-A-63-29751 are examples thereof.

A hydrogen atom is most preferable as $A_1$ and $A_2$.

$R_7$ or $R_8$ in Formula (II) may have a ballast group or a polymer incorporated thereinto, which is conventionally used for an immobile photographic additive such as a coupler. The ballast group is a group which has a carbon number of 8 or more and is comparatively inactive to photographic characteristics. It can be selected from, for example, an alkyl group, an alkoxy group, a phenyl group, an alkylphenyl group, a phenoxy group, and an alkylphenoxy group. Also, the compounds described in JP-A-1-100530 can be the polymer.

In $R_7$ or $R_8$ in Formula (II), a group promoting adsorption to a surface of a silver halide grain may be incorporated thereinto. Such adsorbing groups are the groups described in U.S. Pat. Nos. 4,385,108 and 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245, and JP-A-63-234246, such as a thiourea group, a heterocyclic thioamide group, a mercapto heterocyclic group, and a triazole group.

The compounds represented by Formula (II) can be prepared according to the methods described in U.S. Pat. Nos. 4,080,207 and 4,276,364 or the modified methods thereof.

Concrete examples of the compounds represented by Formula (II) are shown below but the present invention is not limited tereto:

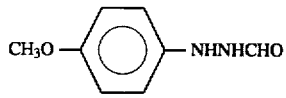

II-1

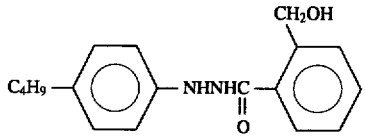

II-2

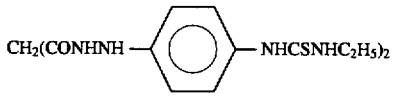

II-3

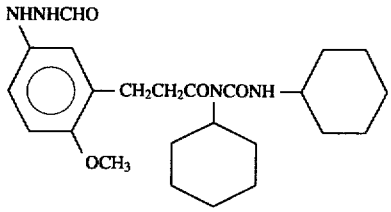

II-4

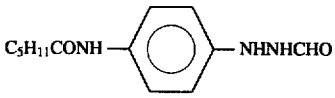

II-5

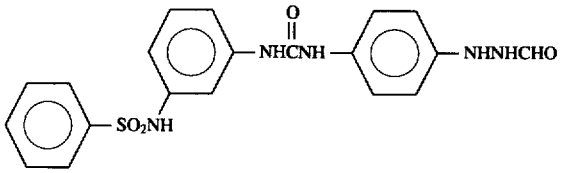

II-6

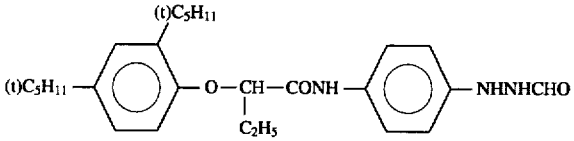

II-7

-continued
II-8
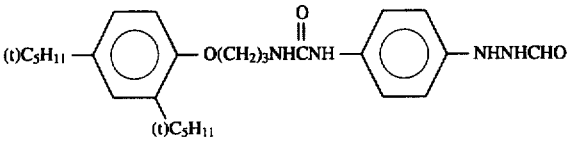
II-9
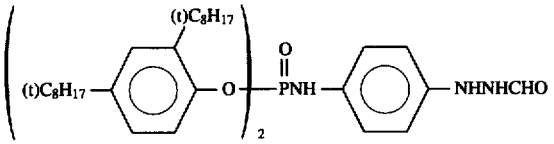
II-10
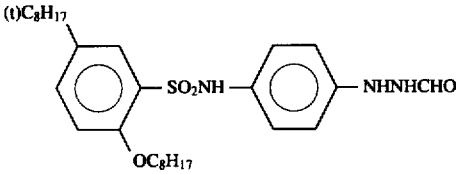
II-11
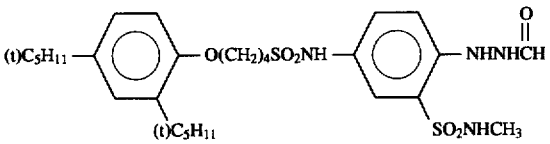
II-12
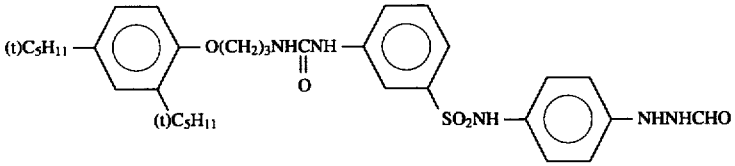
II-13
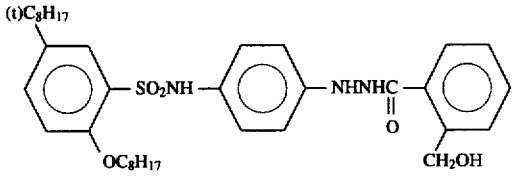
II-14
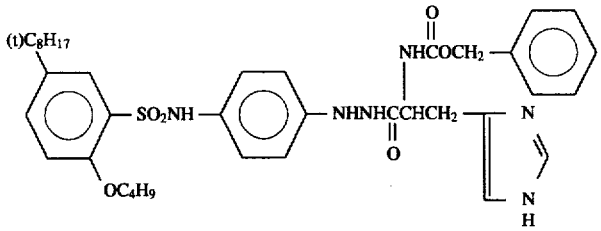
II-15
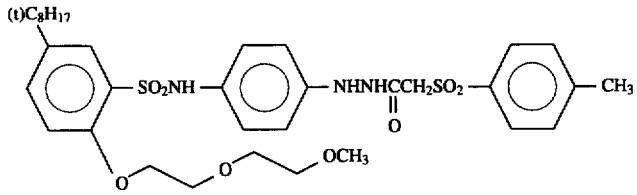
II-16
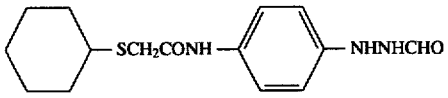
II-17
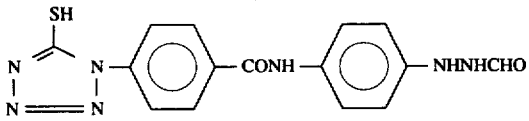

-continued
II-18
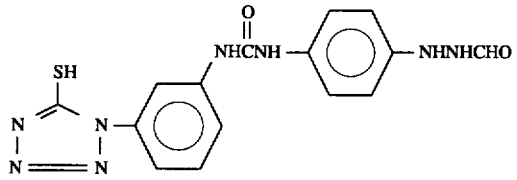
II-19
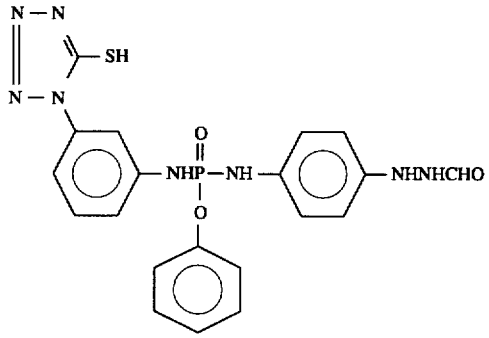
II-20
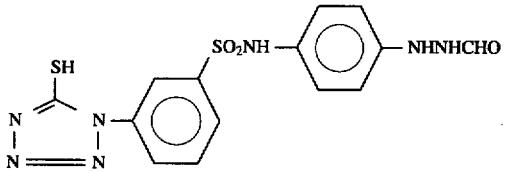
II-21
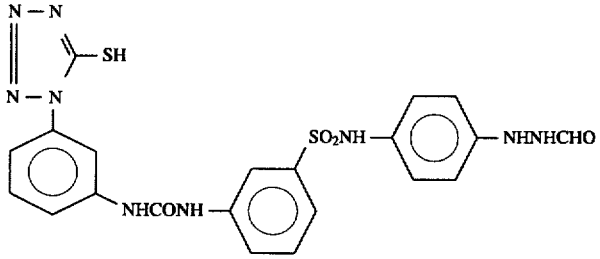
II-22
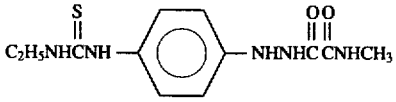
II-23
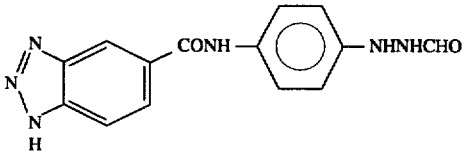
II-24
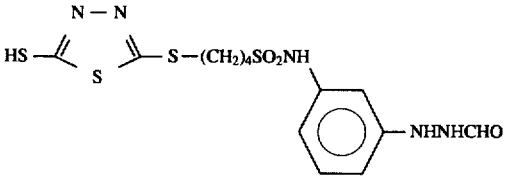
II-25
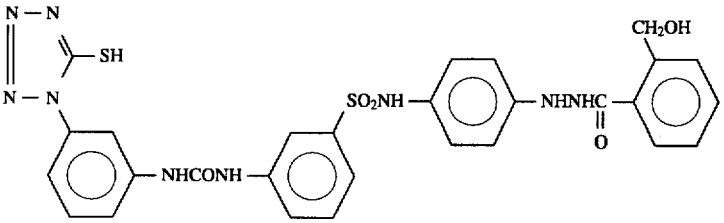

-continued

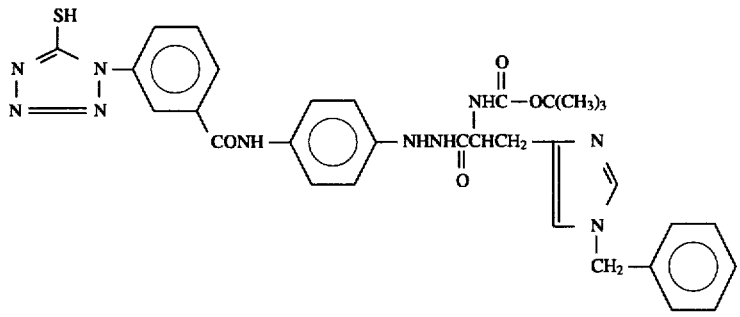

II-26

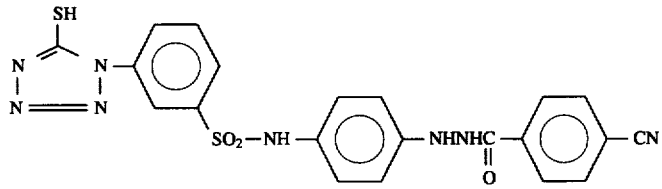

II-27

Among them, Compounds II-7 and II-21 are particularly preferred.

In addition to the above compounds, there can be used as the hydrazine derivatives represented by Formula (II) in the present invention, the compounds described in Research Disclosure Item 23510 (November 1983, pp. 346) and the publications cited therein, and in addition, U.S. Pat. Nos. 4,080,207, 4,269,929, 4,276,364, 4,278,748, 4,385,108, 4,459,347, 4,560,638, and 4,478,928, British Patent 2,011,391B, JP-A-60-179734, JP-A-62-270948, JP-A-63-29751, JP-A-61-170733, JP-A-61-270744, and JP-A-62-270948, EP 217,310, EP 356,898, U.S. Pat. No. 4,686,167, JP-A-62-178246, JP-A-63-32538, JP-A-53-104047, JP-A-63-121838, JP-A-63-129337, JP-A-63-223744, JP-A-63-234244, JP-A-63-234245, JP-A-63-234246, JP-A-63-294552, JP-A-63-306438, JP-A-1-100530, JP-A-1-105941, JP-A-1-105943, JP-A-64-10233, JP-A-1-90439, JP-A-1-276128, JP-A-1-280747, JP-A-1-283548, JP-A-1-283549, JP-A-1-285940, JP-A-63-147339, JP-A-63-179760, JP-A-63-229163, JP-A-2-198440, JP-A-2-198441, JP-A-2-198442, JP-A-2-196234, JP-A-2-196235, JP-A-2-229042, JP-A-2-221953, JP-A-2-221954, JP-A-2-302750 and JP-A-2-304550.

The compounds of the present invention represented by Formula (I) may be used either singly or in combination thereof. In particular, a combination of a sensitizing dyes is often used for the purpose of supersensitization. Representative examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862, and 4,026,707, British Patents 1,344,281 and 1,507,804, JP-B-43-49336 and JP-B-53-12375, and JP-A-52-110618 and JP-A-52-109925.

In addition to the compounds of the present invention represented by Formula (I), there may be contained in an emulsion, compounds which are dyes having no spectral sensitization by themselves or materials which absorb substantially no visible rays but result in a supersensitization.

The timing of adding the compounds of the present invention represented by Formula (I) to an emulsion may be at any step during the preparation of the emulsion, which has so far been known as effective. Usually, it is carried out during the period from after the completion of chemical sensitization to before coating. However, as described in U.S. Pat. Nos. 3,628,969 and 4,225,666, the compounds can be added at the same period as the chemical sensitizer to simultaneously carry out spectral sensitization and chemical sensitization. As described in JP-A-58-113928, spectral sensitization can be carried out prior to chemical sensitization. Also, the compounds can be added before the completion of the precipitation and formation of the silver halide grains to initiate spectral sensitization. Further, as taught in U.S. Pat. No. 4,225,666, divided sensitizing dyes can be added; that is, a part thereof is added prior to chemical sensitization and the remainder is added after chemical sensitization. The addition of the compounds represented by Formula (I) may be at any period during the formation of the silver halide grains, as well as accoding to the method taught in U.S. Pat. No. 4,183,756. The addition amount of the compounds of the present invention represented by Formula (I) can be used in a proportion of $4\times10^{-6}$ to $8\times10^{-3}$ mole per mole of silver halide. It is more effectively about $5\times10^{-5}$ to $2\times10^{-3}$ mole per mole of silver halide in case of a more preferable silver halide grain size of 0.2 to 1.2 μm.

The compounds represented by Formula (I) used in the present invention can be dispersed directly into an emulsion. Further, they can first be dissolved in a suitable solvent, for example, methyl alcohol, ethyl alcohol, methyl cellosolve, acetone, water, pyridine, or the mixed solvent thereof and then added to the emulsion in the form of a solution. A supersonic wave can be used as well for dissolving them. There can be used as the method for adding these sensitizing dyes, the method in which the dye is dissolved in a volatile organic solvent and the solution is dispersed in a hydrophilic colloid, followed by the addition of this dispersion to an emulsion, as described in U.S. Pat. No. 3,469,987; the method in which a water insoluble dye is dispersed in a water soluble solvent without dissolving it and this dispersion is added to an emulsion, as described in JP-B-46-24185; the method in which a water insoluble dye is mechanically pulverized and dispersed into a water soluble solvent and this dispersion is added to an emulsion, as described in JP-B-61-45217; the method in which a dye is dissolved in a surface active agent and the solution is added to an emulsion, as described in U.S. Pat. No. 3,822,135; the method in which a dye is dissolved with a compound which can shift it to a red region and the solution is added to an emulsion, as described in JP-A-51-74624; and the method in which a dye is dissolved in an acid containing substantially no water and the solution is added to an emulsion, as described in JP-A-50-80826. In addition to the above, there can be used for adding the dyes to the emulsions, the methods described in U.S. Pat. Nos. 2,912,343, 3,342,605, 2,996,287, and 3,429,835. The above sensitizing dyes may be uniformly dispersed in the emulsions before they are coated on a suitable support, and they can naturally be dispersed during any process step in the preparation of the emulsions.

In the present invention, the addition amount of the hydrazine derivative represented by Formula (II) is preferably $1\times10^{-6}$ to $5\times10^{-2}$ mole per mole of silver halide, and in particular, a preferred addition amount is $1\times10^{-5}$ to $2\times10^{-2}$ mole per mole of silver halide.

The hydrazine derivatives represented by Formula (II) used in the present invention can be dissolved in a suitable water-miscible solvent, for example, alcohols (methanol, ethanol, propanol, and fluorinated alcohol), ketones (acetone and methyl ethyl ketone), dimethylformamide, dimethylsulfoxide, and methyl cellosolve.

Further, the hydrazine derivatives can be dissolved with the aid of an oil such as dibutyl phthalate, tricresyl phosphate, glyceryl triacetate, and diethyl phthalate, and an auxiliary solvent such as ethyl acetate and cyclohexanone to mechanically prepare the emulsified dispersions thereof by the well known dispersing methods.

Alternatively, powders of the hydrazine derivatives can be dispersed in water by the method known as a solid matter dispersing method with a ball mill, a colloid mill or a supersonic wave.

Particularly preferred combinations of the compounds of Formulae (I) and (II) are I-1 and II-17, and I-29 and II-17.

The silver halide grains used in the present invention may be of a regular crystal such as cube, octahedron and tetradecahedron, an irregular crystal such as sphere and plate, a defective crystal such as a twinned crystal, or a composite form thereof.

The grain size of silver halide may be either a fine grain of about 0.2 μm or less, or a large grain having a projected area-circle corresponding a diameter of up to about 10 μm. Preferred silver halide grain size is 0.2 to 1.2 μm. The silver halide emulsion may be either a polydispersed emulsion or a monodispersed emulsion.

The silver halide photographic emulsion used in the present invention can be prepared by the methods described in, for example, Research Disclosure (RD) No. 17643 (December 1978), pp. 22 to 23, "I. Emulsion Preparation and Types", No. 18716 (November 1979), pp. 648, and No. 307105 (November 1989), pp. 863 to 865, "Chimie et Physique Photographique" written by P. Glafkides, published by Paul Montel Co. (1967), *Photographic Emulsion Chemistry* written by G. F. Duffin, published by Focal Press Co. (1966), and *Making and Coating Photographic Emulsion* written by V. L. Zelikman et al, published by Focal Press Co. (1964). Also preferred are the monodispersed emulsions described in U.S. Pat. Nos. 3,574,628 and 3,655,394, and British Patent 1,413,748.

There can be used as well in the present invention, an emulsion containing AgX grains having aspect ratio (a projected area-circle corresponding diameter of the AgX grains/grain thickness) of about 3 or more by 50% (area) or more based on the whole AgX grains contained in the emulsion. The tabular grains can readily be prepared by the methods described in *Photographic Science and Engineering* written by Gutoff, vol. 14, pp. 248 to 257 (1970), U.S. Pat. Nos. 4,434,226, 4,414,310, 4,433,048, and 4,439,520, and British Patent 2,112,157.

Silver halide used in the present invention may be, for example, silver chloride, silver bromide, silver iodide, silver bromochloride, silver chloroiodide, silver bromoiodide, and silver bromochloroiodide.

Single jet method, a double jet method or a combination thereof may be used as the method for reacting a water soluble silver salt with a water soluble halide. There can be used as well the method in which the grains are formed in the presence of excessive silver ions (a so-called reverse mixing method). There can be used as one form of the double jet method, the method in which pAg of the solution in which the sliver halide grains are formed is maintained constant, a so-called controlled double jet method. There can be obtained with this method, a silver halide emulsion having a regular crystal form and an almost uniform grain size.

There can be used as the silver halide solvent for controlling the growth of the grains in the preparation of the silver halide grains used in the present invention, for example, ammonia, potassium rhodanide, ammonium rhodanide, the thioether compounds (for example, in U.S. Pat. Nos. 3,271,157, 3,574,628, 3,704,130, 4,297,439, and 4,276,374), the thione compounds (for example, in JP-A-53-144319, JP-A-53-82408, and JP-A-55-77737), and the amine compounds (for example, in JP-A-54-100717).

In the present invention, preferably used are water soluble rhodium salts, for example, rhodium chloride, rhodium trichloride, and rhodium ammonium chloride. Further, the complex salts thereof can be used. The addition timing of the above rhodium salts is limited to before the completion of the first ripening in the preparation of an emulsion. In particular, they are added preferably during the formation of the grains. The addition amount thereof is preferably $1\times10^{-8}$ mole to $1\times10^{-6}$ mole per mole of silver.

Further, a water soluble iridium salt such as, for example, $Na_3IrCl_6$:$Na_2IrCl_6$ can be used. The addition timing of the water soluble iridium salt is before the first ripening in the preparation of an emulsion. In particular, it is added preferably during the formation of the grains. The addition amount thereof is preferably $1\times10^{-8}$ mole to $1\times10^{-5}$ mole per mole of silver.

Various gold salts are available as the gold sensitizer used in the present invention. They are, for example, potassium chloroaurite, potassium auric-thiocyanate, potassium chloroaurate, and auric trichloride. Concrete examples thereof are described in U.S. Pat. Nos. 2,399,083 and 2,642,361.

In addition to the sulfur compounds contained in gelatin, various sulfur compounds, for example, thiosulfate, thiourea, thiazoles, and rhodanines can be used as the sulfur sensitizer used in the present invention. Concrete examples thereof are the compounds described in U.S. Pat. Nos. 1,574,944, 2,278,947, 2,410,689, 2,728,668, 3,501,313, and 3,656,955.

The preferred sulfur compounds are thiosulfate and the thiourea compounds.

The preferred addition amounts of the sulfur sensitizer and gold sensitizer are each $10^{-2}$ to $10^{-7}$ mole, more preferably $1\times10^{-3}$ to $5\times10^{-6}$ mole, per mole of silver.

The ratio of the sulfur sensitizer and gold sensitizer is generally 1:3 to 3:1, preferably 1:2 to 2:1 in terms of a mole ratio.

In the present invention, a reduction sensitizing method can be used.

There can be used as a reduction sensitizer, a stannous salt, amines, formamidinesulfinic acid, and a silane compound.

The temperature at which a chemical sensitization is carried out in the present invention can be selected from the temperatures falling within the range of 30° to 90° C. The chemical sensitization is carried out at a pH of 4.5 to 8.5, preferably 5.0 to 7.0. The time for the chemical sensitization is changed according to temperature, the use amount of the chemical sensitizer, and pH and therefore it can not readily be predetermined. It can be selected from the range between several minutes to several hours. Usually, it is carried out in 10 to 200 minutes.

When a silver halide emulsion is subjected to infrared spectral sensitization, the stability of the emulsion in a solution status is deteriorated in some cases. It is effective for the prevention thereof to add water soluble bromide. Various compounds capable of dissociating to a bromine ion can be used as the water soluble bromide. There can be used the bromide salts, for example, the salts of ammonium, potassium, sodium, and lithium. Further, there can be used suitable organic bromide, for example, tetraethylammonium bromide and ethylpyridinium bromide.

However, of the bromide salts, the excessive absorption of cadmium bromide and zinc bromide will be hazardous to human body and therefore the above mentioned non-hazardous water soluble bromides are preferred.

The amount of the water soluble bromides added to an emulsion is the amount sufficient for substantially increasing the sensitivity of the emulsion and/or substantially preventing the sensitivity from changing over time. The amount of the water soluble bromides can be changed over a wide range. Particularly good results can be obtained when the bromide is added in the range of 0.0003 to 0.01 mole per mole of silver. Even better results can be obtained when the bromide is added in the range of 0.0005 to 0.005 mole per mole of silver. The above amount of bromide is the amount obtained by adding the amount of the negative ion of a sensitizing dye when the negative ion of the sensitizing dye is bromine or bromide.

The timing for adding the water soluble bromide may be any time after the formation of the silver halide grains. It is preferably after the completion of chemical sensitization.

Various compounds can be added to the photographic emulsion of the present invention in order to prevent the reduction of sensitivity and the generation of fog during the manufacturing process storage or processing. There have so far been known as those compounds, heterocyclic compounds, mercury-containing compounds, mercapto compounds and metal salts, including nitrobenzimidazole, ammonium chloroplatinate, 4-hydroxy-6-methyl-1,3,3a,7-tetrazaindene, and 1-phenyl-5-mercaptotetrazole. In addition to the compounds described on pages 344 to 349 in *The Theory of the Photographic Process* written by K. Mees (the third edition, 1966), there are available as the compounds, for example, the thiazolium salts described in U.S. Pat. Nos. 2,131,038 and 2,694,716; azaindenes described in U.S. Pat. Nos. 2,886,437 and 2,444,605; urazoles described in U.S. Pat. No. 3,287,135; sulfocatechols described in U.S. Pat. No. 3,236,652; oximes described in British Patent 623,448; mercaptotetrazoles and nitrones described in U.S. Pat. Nos. 2,403,927, 3,266,897, and 3,397,987; nitro-indazoles; the polyvalent metal salts described in U.S. Pat. No. 2,839,405; the thiuronium salts described in U.S. Pat. No. 3,220,839; and the salts of palladium, platinum and gold described in U.S. Pat. Nos. 2,566,263 and 2,597,915.

There can be incorporated into a silver halide photographic emulsion, a developing agent, for example, hydroquinones; catechols; aminophenols; 3-pyrazolidones; ascorbic acid and the derivatives thereof; reductones, phenylenediamines or a combination thereof with a developing agent. The developing agents can be incorporated into a silver halide emulsion and/or the other photographic layers (for example, a protective layer, an intermediate layer, a filter layer, an anti-halation layer, and a back layer). The developing agents can be added after being dissolved in a suitable solvent or in the form of the dispersions described in U.S. Pat. No. 2,592,368 and French Patent 1,505,778.

There can be used as a development accelerator, the compounds described in U.S. Pat. Nos. 3,288,612, 3,333,959, 3,345,175, and 3,708,303, British Patent 1,098,748, and German Patents 1,141,531 and 1,183,784.

An inorganic or organic hardener can be incorporated into the photographic emulsion of the present invention. There can be used singly or in combination, for example, a chromium salt (chromium alum and chromium acetate), aldehydes (formaldehyde, glyoxal, and glutaraldehyde), an N-methylol compound (dimethylolurea and methyloldimethylhydantoin), a dioxane derivative (2,3-dihydroxydioxane), an active vinyl compound (1,3,5-triacryloyl-hexahydro-s-triazine, bis(vinylsulfonyl)methyl ether and N,N'-methylenebis-[β-(vinylsulfonyl)-propionamide]), an active halogen compound (2,4-dichloro-6-hydroxy-s-triazine), mucohalogenic acid (mucochloric acid and mucophenoxychloric acid), isoxazoles, dialdehyde starch, and 2-chloro-6-hydroxytriadinylized gelatin. Concrete examples thereof are described in U.S. Pat. Nos. 1,870,354, 2,080,019, 2,726,162, 2,870,013, 2,983,611, 2,992,109, 3,047,394, 3,057,723, 3,103,437, 3,321,313, 3,325,287, 3,362,827, 3,539,644, and 3,543,292, British Patents 676,628, 826,544, and 1,270,578, German Patents 872,153 and 1,090,427, and JP-B-34-7133 and JP-B-46-1872.

The photographic emulsion layers and other hydrophilic colloid layers of the photographic material prepared according to the present invention may contain various surface active agents for various purposes such as a coating aid, to prevent electrification, to improve sliding performance, for an emulsification-dispersion, the prevention of sticking, and to improve the photographic characteristics (for example, development acceleration, harder gradation and sensitization).

Examples thereof include nonionic surface active agents such as, saponin (asteroid type), an alkylene oxide derivative (for example, polyethylene glycol, a polyethylene glycol/polypropyrene glycol condensation product, polyethylene glycol alkyl ethers, polyethylene glycol alkyl aryl ethers, polyethylene glycol esters, polyethylene glycol sorbitan esters, polyalkylene glycol alkylamines or amides, and adducts of silicon and polyethylene oxide), a glycidol derivative (for example, alkenylsuccinic acid polyglyceride and alkylphenol polyglyceride), fatty acid esters of polyhydric alcohol, and alkyl esters of sucrose; the anionic surfactants having acid groups including a carboxy group, a sulfo group, a phospho group, a sulfuric acid ester group and a phosphoric acid ester group, such as an alkylcarbonic acid salt, an alkylsulfonic acid salt, an alkylbenzenesulfonic acid salt, an alkylnaphthalenesulfonic acid salt, alkyl-sulfuric acid esters, alkylphosphoric acid esters, N-acyl-N-alkyltaurines, sulfosuccinic acid esters, sulfoalkyl polyoxyethylene-alkylphenyl ethers, and polyoxyethylene alkylphosphoric acid esters; the amphoteric surfactants such as amino acids, aminoalkylsulfonic acids, aminoalkylsulfonic acid or -phosphoric acid esters, alkylbetains, and amine oxides; and the cationic surfactants such as alkylamine salts, aliphatic or aromatic quaternary ammonium salt, pyridinium, heterocyclic quaternary ammonium salts such as imidazolium, and aliphatic or heterocyclic-containing phosphonium or sulfonium salts.

There can be used for the purposes of improving sharpness at a foot portion in a characteristic curve, and obtaining a halftone dot and a line image each having a good quality, the polyalkylene oxide compounds (for example, alkylene oxide having a carbon number of 2 to 4, for example, ethylene oxide, propylene-1,2-oxide, and butylene-1,2-oxide, preferably the condensation product of polyalkylene oxide consisting of at least ten units of ethylene oxide with a compound having at least one active hydrogen atom such as water, aliphatic alcohol, aromatic alcohol, fatty acid, organic amine and a hexitol derivative, or a block copolymer of two or more kinds of polyalkylene oxides). Examples of the compounds include the polyalkylene oxide compounds described in JP-A-50-156423, JP-A-52-108130, and JP-A-53-3217. These polyalkylene oxide compounds may be used singly or in combination of two or more.

Gelatin is advantageously used as a binder or protective colloid for a photographic emulsion. In addition to gelatin, other hydrophilic colloids can be used. There can be used, for example, proteins such as a gelatin derivative, a graft polymer of gelatin and the other polymers, albumin, and casein; cellulose derivatives such as hydroxyethyl cellulose, caboxymethyl cellulose and cellulose sulfuric acid esters; sucrose derivatives such as sodium alginate and a starch derivative; and various synthetic hydrophilic polymers such as homopolymers and copolymers of vinyl alcohol, partially-acetalized vinyl alcohol, N-vinyl-pyrrolidone, acrylic acid, methacrylic acid, acrylamide, vinylimidazole, and vinylpyrazole.

In addition to lime-treated gelatin, acid-treated gelatin may be used as the gelatin. A gelatin hydrolysis product and a gelatin enzyme-decomposed product can be used as well. There are used as the gelatin derivative, the compounds obtained by reacting gelatin with various compounds, for example, acid halide, acid anhydride, isocyanates, bromoacetic acid, alkane saltons, vinylsulfon amides, maleinimide compounds, polyalkylene oxides, and epoxy compounds. Examples thereof are described in U.S. Pat. Nos. 2,614,928, 3,132,945, 3,186,846, and 3,312,553, British Patents 861,414, 1,033,189, and 1,005,784, and JP-B-42-26845.

The dispersion of a water insoluble or scarcely soluble synthetic polymer can be incorporated into the photographic emulsion of the present invention for the purpose of improving dimensional stability. There can be used, for example, a polymer in which the monomer component thereof comprises a single component or a combination of alkyl (metha)acrylate, alkoxyalkyl (metha)acrylate, glycdyl (metha)acrylate, (metha)acrylamide, vinyl ester (for example, vinyl acetate), acrylonitrile, olefin, and styrene, or the combination of acrylic acid, methacrylic acid, α, β-unsaturated dicarboxylic acid, hydroxyalkyl (metha)acrylate, sulfo-alkyl (metha)acrylate, and styrenesulfonic acid therewith.

The above additives can be used for the photographic material according to the present invention and in addition thereto, various other additives can be used as well according to the purpose.

More details of these additives are described in Research Disclosures Item 17643 (December 1978) and Item 18716 (November 1979), and the corresponding portions thereof are summarized and shown in the following table.

| Kind of additives | RD 17643 | RD 18716 |
|---|---|---|
| 1. Chemical sensitizer | — | pp. 648, right colmn. |
| 2. Sensitivity improver | — | pp. 648, right colmn. |

-continued

| Kind of additives | RD 17643 | RD 18716 |
|---|---|---|
| 3. Spectral sensitizer | pp. 23 to 24 | pp. 648, right colmn. to pp. 649, right colmn. |
| Super-sensitizer | — | |
| 4. Whitening agent | pp. 24 | — |
| 5. Anti-foggant & stabilizer | pp. 24 to 25 | pp. 649, right colmn. |
| 6. Light absorber, filter dye, & UV absorber | pp. 25 to 26 | pp. 649, right colmn. to pp. 650, left colmn. |
| 7. Anti-stain agent | pp. 25, right colmn. | pp. 650, left colmn. to right colmn. |
| 8. Dye image stabilizer | pp. 25 | — |
| 9. Hardener | pp. 26 | pp. 651, left colmn. |
| 10. Binder | pp. 26 | pp. 651, left colmn. |
| 11. Plasticizer & lubricant | pp. 27 | pp. 650, right colmn. |
| 12. Coating aid & surfactant | pp. 26 to 27 | pp. 650, right colmn. |
| 13. Anti-static agent | pp. 27 | pp. 650, right colmn. |

Various color couplers can be used for the present invention and examples thereof are described in the patents abstracted in above Research Disclosure (RD) No. 17643, VII-C to G.

Preferred as a yellow coupler are the compounds described in, for example, U.S. Pat. Nos. 3,933,501, 4,022,620, 4,326,024, and 4,401,752, JP-B-58-10739, and British Patents 1,425,020 and 1,476,760.

The 5-pyrazolone series and pyrazoloazole series compounds are preferred as a magenta coupler. Particularly preferred are the compounds described in U.S. Pat. Nos. 4,310,619 and 4,351,897, European Patent 73,636, U.S. Pat. Nos. 3,061,432 and 3,725,067, Research Disclo-sure No. 24220 (June 1984), JP-A-60-33552, Research Dis-closure No. 24230 (June 1984), JP-A-60-43659, and U.S. Pat. Nos. 4,500,630 and 4,540,654. There can be enumerated as a cyan coupler, the phenol series and naphthol series couplers. Preferred are the compounds described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011, and 4,327,173, German Patent Publication 3,329,729, European Patent 121,365A, U.S. Pat. Nos. 3,446,622, 4,333,999, 4,451,559, and 4,427,767, and European Patent 161,626A.

Preferred as a colored coupler used for correcting any unnecessary absorption of a developed dye are the compounds described in Research Disclosure No. 17643, Item VII-G, U.S. Pat. No. 4,163,670, JP-B-57-39413, U.S. Pat. Nos. 4,004,929 and 4,138,258, and British Patent 1,146,368.

Preferred as a coupler capable of forming a developed dye having an appropriate dispersing property are the compounds described in U.S. Pat. No. 4,366,237, British Patent 2,125,570, European Patent 96,570, and German Patent (published) 3,234,533.

Typical examples of a polymerized dye-forming coupler are described in U.S. Pat. Nos. 3,451,820, 4,080,211, and 4,367,282, and British Patent 2,102,173.

There can be preferably used as well in the present invention, a coupler releasing a photographically useful residue upon coupling. Preferred as a development inhibitor-releasing DIR coupler are the compounds described in the patents abstracted in above RD 1764, VII-F, JP-A-57-151944, JP-A-57-154234 and JP-A-60-184248, and U.S. Pat. No. 4,248,962.

Preferred as a coupler releasing imagewise a nucleus-forming agent or a development accelerator during developing are the couplers described in British Patents 2,097,140 and 2,131,188, and JP-A-59-157638 and JP-A-59-170840.

In addition to the above compounds, there can be enumerated as the couplers capable of being used for the photographic material according to the present invention, the competitive couplers described in U.S. Pat. No. 4,130,427; the polyequivalent couplers described in U.S. Pat. Nos. 4,283,472, 4,338,393 and 4,310,618; the DIR redox compounds, DIR coupler-releasing couplers, or DIR coupler-releasing couplers or redoxes described in JP-A-60-185950 and JP-A-62-24252; the couplers releasing a dye whose color is recovered after releasing, described in European Patent 173,302A; the bleaching accelerator-releasing couplers described in R. D. No. 11449 and No. 24241, and JP-A-61-201247; and the ligand-releasing couplers described in U.S. Pat. No. 4,553,477.

The developing agent applied to the developing solution used in the present invention is not specifically limited. In the case of a black and white photographic material, dihydroxybenzenes are preferably contained therein. There are used in some cases, a combination of dihydroxybenzenes and 1-phenyl-3-pyrazolidones, or a combination of dihydroxy-benzenes and p-aminophenols.

There are available as the dihydroxybenzene developing agent used in the invention, hydroquinone, chlorohydroquinone, bromohydroquinone, isopropylhydroquinone, methylhydroquinone, 2,3-dichlorohydroquinone, 2,5-dichlorohydroquinone, 2,3-dibromohydroquinone, and 2,5-dimethylhydroquinone. Of them, hydroquinone is particularly preferred.

There are available as the 1-phenyl-3-pyrazolidone developing agent or the derivatives thereof, 1-phenyl-3-pyrazolidone, 1-phenyl-4,4-dimethyl-3-pyrazolidone, 1-phenyl-4-methyl-4-hydroxymethyl-3-pyrazolidone, 1-phenyl-4,4-dihydroxymethyl-3-pyrazolidone, 1-phenyl-5-methyl-3-pyrazolidone, 1-p-aminophenyl-4,4-dimethyl-3-pyrazolidone, 1-p-tolyl-4,4-dimethyl-3-pyrazolidone, and 1-p-tolyl-4-methyl-4-hydroxymethyl-3-pyrazolidone.

There can be given as the p-aminophenol developing agent, N-methyl-p-aminophenol, p-aminophenol, N-(β-hydroxyethyl)-p-aminophenol, N-(4-hydroxyphenyl) glycine, 2-methyl-p-aminophenol, and p-benzylamino-phenol. Among them, N-methyl-p-aminophenol is preferred.

Usually, the developing agent is used preferably in the amount of 0.05 to 0.8 mol/liter. Where a combination of dihydroxybenzenes and 1-phenyl-3-pyrazolidones or p-aminophenols is used, the former is used preferably in the amount of 0.05 to 0.5 mol/liter and the latter in an amount of 0.06 mol/liter or less.

In the case of a color photographic material, the developing solution is preferably an alkaline aqueous solution containing an aromatic primary amine series color developing agent as a primary component. An aminophenol series compound is also useful as this color developing agent, but a p-phenylenediamine series compound is preferably used. There can be enumerated as examples thereof, 3-methyl-4-amino-N,N-diethylaniline, 3-methyl-4-amino-N-ethyl-N-β-hydroxyethylaniline, 3-methyl-4-amino-N-ethyl-N-β-methanesulfonamidethylaniline, 3-methyl-4-amino-N-ethyl-β-methoxyethylaniline, and sulfates, chlorinates and p-toluenesulfonates thereof. These compounds can also be used in combination of two or more according to the purpose.

There are added as a preservative to the developing solution, the compounds providing a dissociated sulfurous acid ion, for example, sodium sulfite, potassium sulfite, potassium metabisulfite, and sodium bisulfite. In the case of an infectious developing solution, there may be used formaldehyde sodium bisulfite which scarcely provides a dissociated sulfurous acid ion in the developing solution.

There can be used as the alkali agent for the developing solution used in the present invention, potassium hydroxide, sodium hydroxide, potassium carbonate, sodium carbonate, sodium acetate, potassium tertiary phosphate, diethanolamine, and triethanolamine. Usually, the pH of the developing solution is set at 9 or more, preferably 9.7 or more.

The developing solution may contain an organic compound which is known as an anti-fogging agent or a development inhibitor. There are available as examples thereof, azoles, for example, a benzothiazolium salt, nitroindazoles, nitrobenzimidazles, chlorobenzimidazoles, bromobenzimidazoles, mercaptothiazoles, mercaptobenzothiazoles, mercaptobenzimidazoles, mercatothiadiazoles, aminotriazoles, benzotriazoles, nitrobenzotriazoles, and mercaptotetrazoles (in particular, 1-phenyl-5-mercaptotetrazole); mercaptopyrimidines; mercaptotriazines, for example, a thioketo compound such as oxazolinethione; azaindenes, for example, triazaindenes, tetrazaindenes (in particular, 4-hydroxy-substituted (1,3,3a,7) tetrazaindenes), and pentaazaindenes; benzenethiosulfonic acid, benzenesulfinic acid, benzenesulfonic acid amide, and sodium 2-mercaptobenzimidazole-5-sulfonate.

The same polyalkylene oxide as previously described may be incorporated as the development inhibitor into a developing solution which can be used in the present invention. For example, polyethylene oxide having a molecular weight of 1,000 to 10,000 can be incorporated in the amount of 0.1 to 10 g/liter.

Preferably added as a water softener to the developing solution which can be used in the present invention are nitrilotriacetic acid, ethylenediaminetetraacetic acid, triethylenetetraminehexaacetic acid, and diethylenetriaminepentaacetic acid.

The fixing solution of the composition usually used can be used as a fixing solution.

In addition to thiosulfate and thiocyanate, the organic sulfur compounds, the effects of which as a fixing agent are known, can be used as the fixing agent. The fixing solution may contain a water soluble aluminum salt as a hardener.

The fixing solution can contain a complex of ethylenediaminetetraacetic acid and a trivalent iron ion as a sulfurizing agent.

A processing temperature and a processing time can suitably be settled. Usually, the processing temperature is suitably 18° to 50° C. Meanwhile, a rapid processing of 15 to 120 seconds is preferably carried out with a so-called automatic processor.

Next, the present invention will be explained in further detail with reference to the examples, but the present invention will not be limited only to these examples.

EXAMPLE

The methine compound (refer to Table 1, the comparative compound being S-1) represented by Formula (I), 230 mg/mole of silver, the compound (refer to Table 1) represented by Formula (II), 1.3 g/mole of silver, and polyethylene glycol (molecular weight: about 1000), 300 mg/mole of silver, were added to a cubic silver bromoiodide emulsion of 0.3 μm containing iodide of 2.5 mole %. There were further added thereto, a dispersion of 5-methylbenzotriazole, 4-hydroxy-6-methyl-1,3,3a,7-tetrazaindene and polyethylene acrylate, and sodium2-hydroxy-1,3,5-triazine. Further, 1,3-divinylsulfonyl-2-propanol was added as a hardener adjusting the amount thereof so that a swelling percentage was 120%.

The coating solution thus prepared was coated on a polyethylene terephthalate film support together with a protective layer so that the silver coated amount and gelatin coated amount (the total in the emulsion layer and protective layer) were 3.5 g/m$^2$ and 3.0 g/m$^2$, respectively.

These films were exposed via an exposing wedge for a sensitometry with a 150 lines contact screen and then developed in the developing solution of the following composition at 40° C. for 15 seconds, followed by fixing in the fixing solution GR-F1 manufactured by Fuji Photo Film Co., Ltd., rinsing and drying.

The automatic processor used herein was set at 65 second on Dry to Dry.

| Composition of the developing solution: | |
|---|---|
| Hydroquinone | 50.0 g |
| N-methyl-p-aminophenol | 0.3 g |
| 4-Methyl-4-hydroxymethyl-1-phenyl-3-pyrazolidone | 1.25 g |
| Sodium hydroxide | 18.0 g |
| Potassium secondary phosphate | 38.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzenesulfonate | 0.2 g |
| N-n-butyl diethanolamine | 15.0 g |
| Sodium toluenesulfonate | 8.0 g |
| Water was added to | 1 liter |
| pH was added to (adding potassium hyroxide) | 11.6 |

Fuji F (manufactured by Fuji Photo Film Co., Ltd.) was used for fixing and water containing disodium ethylenediamoinetetraacetate dihydrate (an anti-microbial agent) 0.5 g/liter was used for rinsing.

The sensitivity and residual color after processing are shown in Table 1.

Comparative Compound S-1

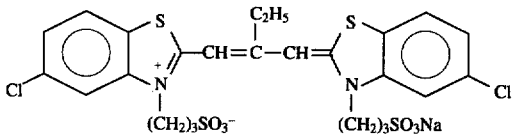

TABLE 1

| Sample No. | Methine ompound of Formula (I) | Compound of Formula (II) | Sensitivity | Residual color |
|---|---|---|---|---|
| 1 (Comp.) | S-1 | II-7 | ±0* | Large |
| 2 (Comp.) | I-1 | — | −0.2 | Small |
| 3 (Inv.) | I-1 | II-7 | +0.02 | Small |
| 4 (Inv.) | I-29 | II-7 | +0.01 | Small |

*Standard for the sensitivity.

It can be found from the results summarized in Table 1 that both sensitivity and residual color properties can be improved with the photographic materials of the present invention.

While the invention has been described in detailed with reference to specific embodiments, it will be apparent to one skilled in the art that various changes and modifications can be made to the invention without departing from its spirit and scope.

What is claimed is:

1. A silver halide photographic material comprising a support having provided thereon at least one silver halide emulsion layer containing at least one methine compound represented by the following Formula (I) and at least one compound represented by the following Formula (II):

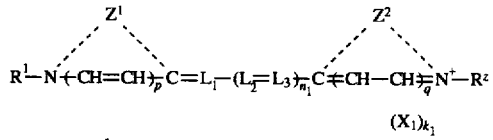

(I)

wherein $R^1$ represents $—(CH_2)_r—CONHSO_2—R^3$, $—(CH_2)_s—SO_2NHCO—R^4$, $—(CH_2)_t—CONHCO—R^5$, or $—(CH_2)_u—SO_2NHSO_2—R^6$, in which $R^3$ $R^4$, $R^5$ and $R^6$ each represents an alkyl group, an alkoxy group, or an amino group and r, s, t and u each represents an integer of 1 to 5; $R^2$ is selected from the group consisting of a 2-sulfoethyl group, a 3-sulfopropyl group, a 4-sulfobutyl group and a 3-sulfobutyl group; $Z^1$ and $Z^2$ may be the same or different and each represents a group of non-metallic atoms necessary to form a benzothiazole, benzoselenazole or quinoline nucleus; $L_1$, $L_2$ and $L_3$ each represents a methine group; $n_1$ represents 0, 1 or 2; $X_1$ represents an anion; $k_1$ represents a number necessary to adjust a charge in the compound to 0; and p and q each represents 0 or 1;

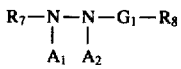

(II)

wherein $R_7$ represents an aliphatic group or an aromatic group; $R_8$ represents a hydrogen atom, an alkyl group, an aryl group, an alkoxy group, an aryloxy group, an amino group, or a hydrazino group; $G_1$ represents —CO—, $—SO_2—$, —SO—, $—P(O)R_9—$, —CO—CO—, a thiocarbonyl group, or an iminomethylene group; both $A_1$ and $A_2$ represent a hydrogen atom, or either of them represents a hydrogen atom and the other represents an alkylsulfonyl group, an arylsulfonyl group, or an acyl group; and $R_9$ is defined in the same manner as $R_8$ and may be the same as or different from $R_8$.

2. The photographic material of claim 1, wherein $R^1$ represents $—(CH_2)_r—CONHSO_2—R^3$.

3. The photographic material of claim 1, wherein $R^1$ represents $—(CH_2)_s—SO_2NHCO—R^4$.

4. The photographic material of claim 1, wherein $R^1$ represents $—(CH_2)_t—CONHCO—R^5$.

5. The photographic material of claim 1, wherein $R^1$ represents $—(CH_2)_u—SO_2NHSO_2—R^6$.

6. The photographic material of claim 1, wherein $A_1$ and $A_2$ are both hydrogen atoms.

7. The photographic material of claim 1, wherein $G_1$ is —CO—.

8. The photographic material of claim 1, wherein $Z^1$ represents a group of non-metallic atoms necessary to form a benzothiazole nucleus.

9. The photographic material of claim 1, wherein $Z^2$ represents a group of non-metallic atoms necessary to form a benzothiazole nucleus.

10. The photographic material of claim 1, wherein $Z^1$ represents a group of non-metallic atoms necessary to form a benzoselenazole nucleus.

11. The photographic material of claim 1, wherein $Z^2$ represents a group of non-metallic atoms necessary to form a benzoselenazole nucleus.

12. The photographic material of claim 1, wherein $Z^1$ represents a group of non-metallic atoms necessary to form a quinoline nucleus.

13. The photographic material of claim 1, wherein $Z^2$ represents a group of non-metallic atoms necessary to form a quinoline nucleus.

* * * * *